US010458127B1

(12) United States Patent
Littlefield

(10) Patent No.: US 10,458,127 B1
(45) Date of Patent: Oct. 29, 2019

(54) WINDOW BRACING DEVICE

(71) Applicant: Bryan F. Littlefield, Bucksport, ME (US)

(72) Inventor: Bryan F. Littlefield, Bucksport, ME (US)

( * ) Notice: Subject to any disclaimer, the term of this patent is extended or adjusted under 35 U.S.C. 154(b) by 0 days.

(21) Appl. No.: 16/113,419

(22) Filed: Aug. 27, 2018

(51) Int. Cl.
*E04F 21/00* (2006.01)

(52) U.S. Cl.
CPC ..... *E04F 21/0023* (2013.01); *E04F 21/0007* (2013.01)

(58) Field of Classification Search
CPC ..... E04F 21/0023; E04F 21/0007
See application file for complete search history.

(56) References Cited

U.S. PATENT DOCUMENTS 2,652,937 A * 9/1953 Cutler ..... E06C 7/12 182/102
8,146,880 B2 * 4/2012 Cheddie ..... E04F 21/0023 248/540
8,910,922 B1 * 12/2014 Erickson ..... E04F 21/0007 254/281
9,599,278 B2 * 3/2017 Ruckman ..... A47L 3/00
9,664,331 B1 * 5/2017 Caputa ..... E04G 25/04
2016/0010790 A1 * 1/2016 Ruckman ..... A47L 3/00 248/419

FOREIGN PATENT DOCUMENTS

CH 708695 A2 * 4/2015 ..... E04F 21/0023
CH 709468 A2 * 10/2015 ..... B62B 1/268

* cited by examiner

*Primary Examiner* — Rodney Mintz
(74) *Attorney, Agent, or Firm* — Anthony D. Pellegrini

(57) ABSTRACT

A window bracing device which is used to support a window unit within a window opening of a wall of a structure while that window unit is being secured to the structure, with the window bracing device being temporarily attached to the window unit on the interior side of the window unit, then braced against the interior of the wall surrounding the window opening, retaining the window unit in place while a worker secures the window unit to the wall; wherein the window bracing device is comprised of a bracing arm, a first foot, a second foot, a window engagement member, and an attachment component.

15 Claims, 4 Drawing Sheets

WINDOW BRACING DEVICE

BACKGROUND OF THE INVENTION

1. Technical Field

The present invention relates generally to tools used in the construction industry. More particularly, the present invention relates to a device used to temporarily support a window within a window opening so that the window can be secured to the structure.

2. Description of Prior Art

When constructing a structure having windows, such as a house or an office building, typically a wall is first constructed having a window opening formed therein. The window opening is framed, and then a window unit, consisting of a window frame enclosing one or more glass panes, is inserted into the window opening. However, the window unit is relatively heavy, and will not remain in its proper orientation without external support. That is, until it is secured to the structure, the window unit will tend to fall out of the window opening in the direction of the exterior of the structure. During installation, then, the typical process involves placing the window unit into the window opening, then having a worker brace the window unit in place from the exterior of the structure while a second worker secures the window unit to the wall from the inside of the structure. This process is inefficient, in that it requires two workers rather than just one worker to install a window unit. Moreover, the worker bracing the window unit from the exterior of the structure may not be holding the window in the exact orientation as desired, or even if the correct orientation is initially achieved, the window could slip slightly out of position, because its weight makes it difficult for the worker to hold it perfectly still for an extended period of time. Finally, if the window opening is above grade (such as a second story window), the worker bracing the window requires a ladder or scaffolding, with the added inherent risk of using such devices.

It has thus been demonstrated that there is a need for a device for bracing a window unit during installation that obviates the need for the second worker. Such a device will add efficiency to the window installation process. It will also allow for more precise placement of the window unit within the window opening for a more perfect fit. It will also reduce the safety risk in the window installation process.

It is therefore an object of the present invention to present a window bracing device which allows a single worker to install a window unit into a window opening without needing assistance from a second worker to brace the window unit while it is being secured to the structure.

It is a further object of the present invention to present a window bracing device which holds a window unit in its correct position without slippage.

It is yet a further object of the present invention to present a window bracing device which reduces the safety risk to workers during the window installation process.

It is yet a further object of the present invention to present a window bracing device that is adjustable to be compatible with differently configured windows and differently configured window openings.

Other objects of the present invention will be readily apparent from the description that follows.

SUMMARY OF THE INVENTION

The present invention discloses a window bracing device which is used to support a window unit within a window opening of a wall of a structure while that window unit is being secured to the structure. The window bracing device is temporarily attached to the window unit on the interior side of the window unit, then braced against the interior of the wall surrounding the window opening. So braced, the window unit is retained in place while a worker secures the window unit to the wall. The window bracing device is comprised of a bracing arm, a first foot, a second foot, a window engagement member, and an attachment component. The bracing arm, which is an elongate, rigid member, extends laterally such that each end of the bracing arm extends beyond an edge of the window unit. The window engagement member, which is designed to be temporarily secured to the window pane of the window unit, is attached to the bracing arm via the attachment component. The first foot and the second foot are located at the opposite ends of the bracing arm and engage with the wall on either side of the window unit.

In various embodiments, the attachment component, the first foot, and the second foot are adjustable relative to the bracing arm, so that the bracing arm can be attached to a window unit regardless of the window unit's configuration and braced against any wall regardless of the configuration of that wall. The adjustment capabilities also allow the window bracing device initially to be applied loosely so that the window unit can be perfectly positioned, and then tightened to lock the window unit in place in the correct orientation. In yet other variations the ends of the bracing arm are extendable, to increase the reach of the device. In the preferred embodiments, the window engagement member is a heavy duty suction cup, suitable for strongly attaching to the window pane of the window unit without marring the glass.

It is to be understood that the foregoing and following description of the invention is intended to be illustrative and exemplary rather than restrictive of the invention as claimed. These and other aspects, advantages, and features of the invention will become apparent to those skilled in the art after review of the entire specification, accompanying figures, and claims incorporated herein.

DETAILED DESCRIPTION OF THE INVENTION

Figure 1:
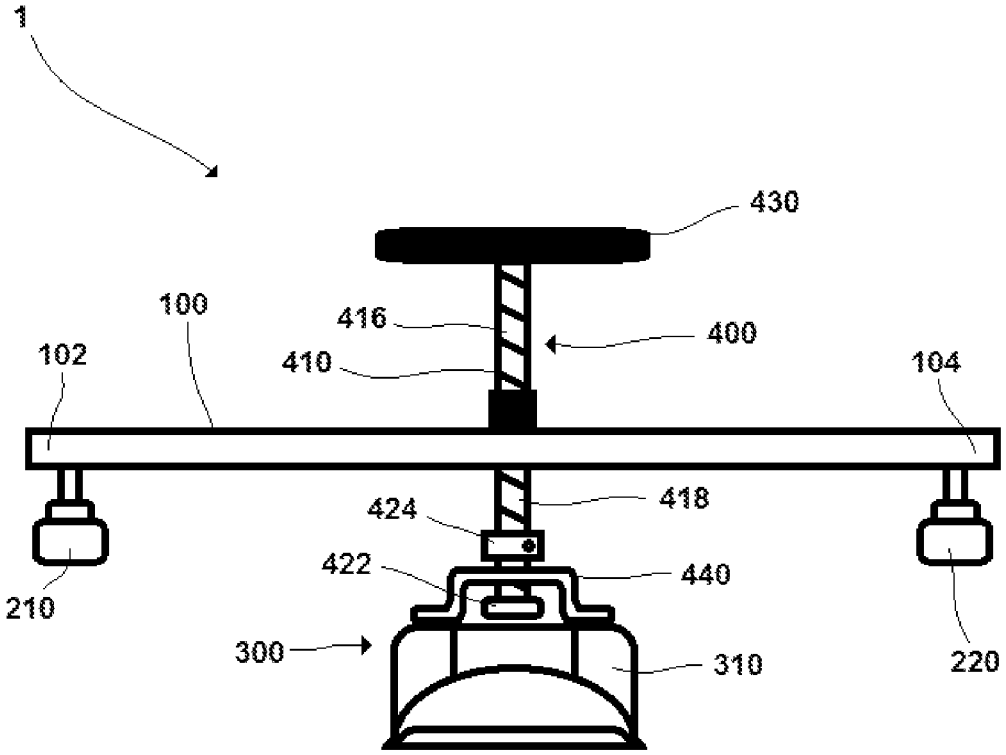
FIG. 1 is a plan front view of one embodiment of the window bracing device of the present invention.
Figure 2:
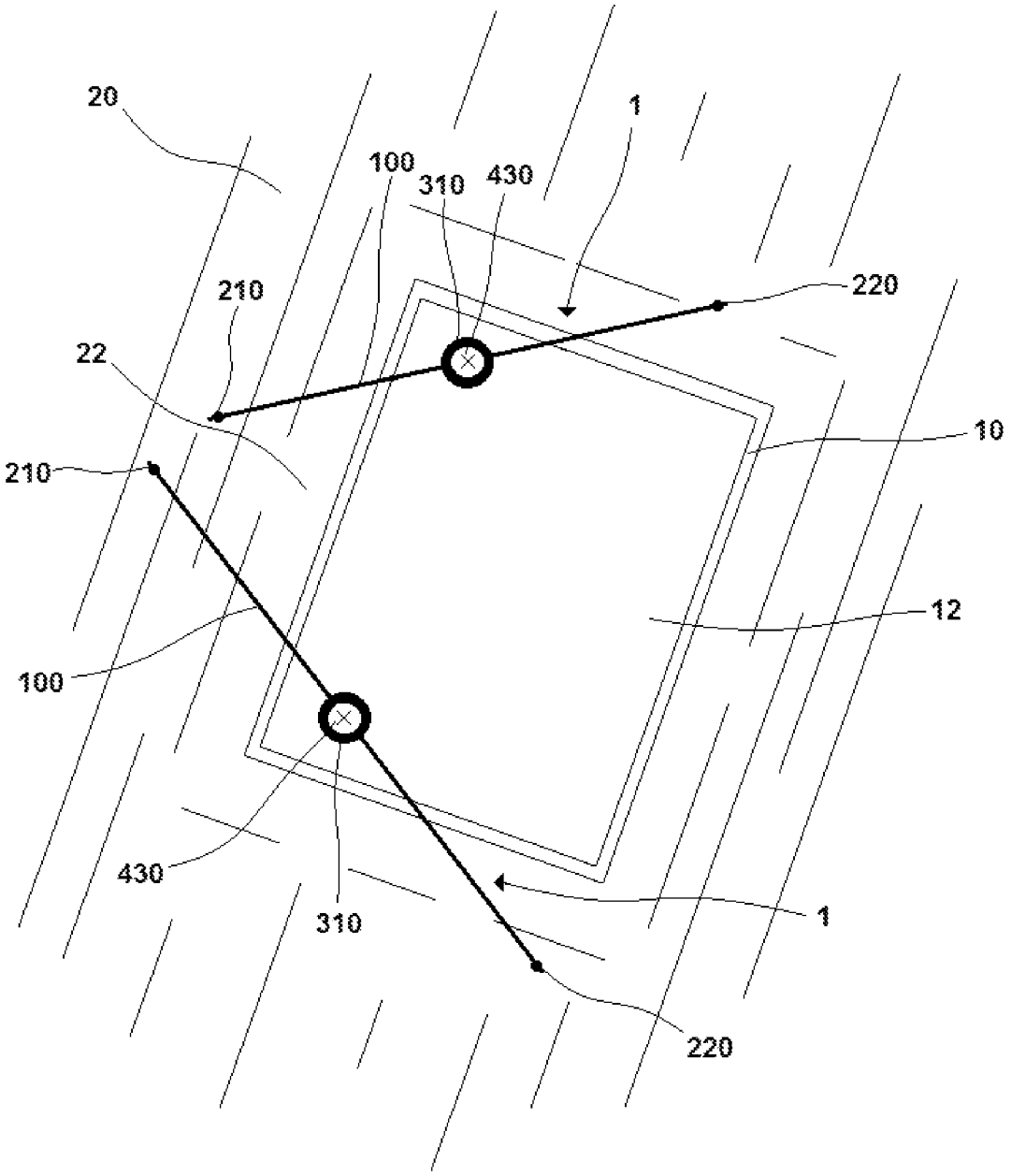
FIG. 2 is a perspective front view of a window unit being supported within a window opening of a wall by a pair of window bracing devices.
Figure 3:
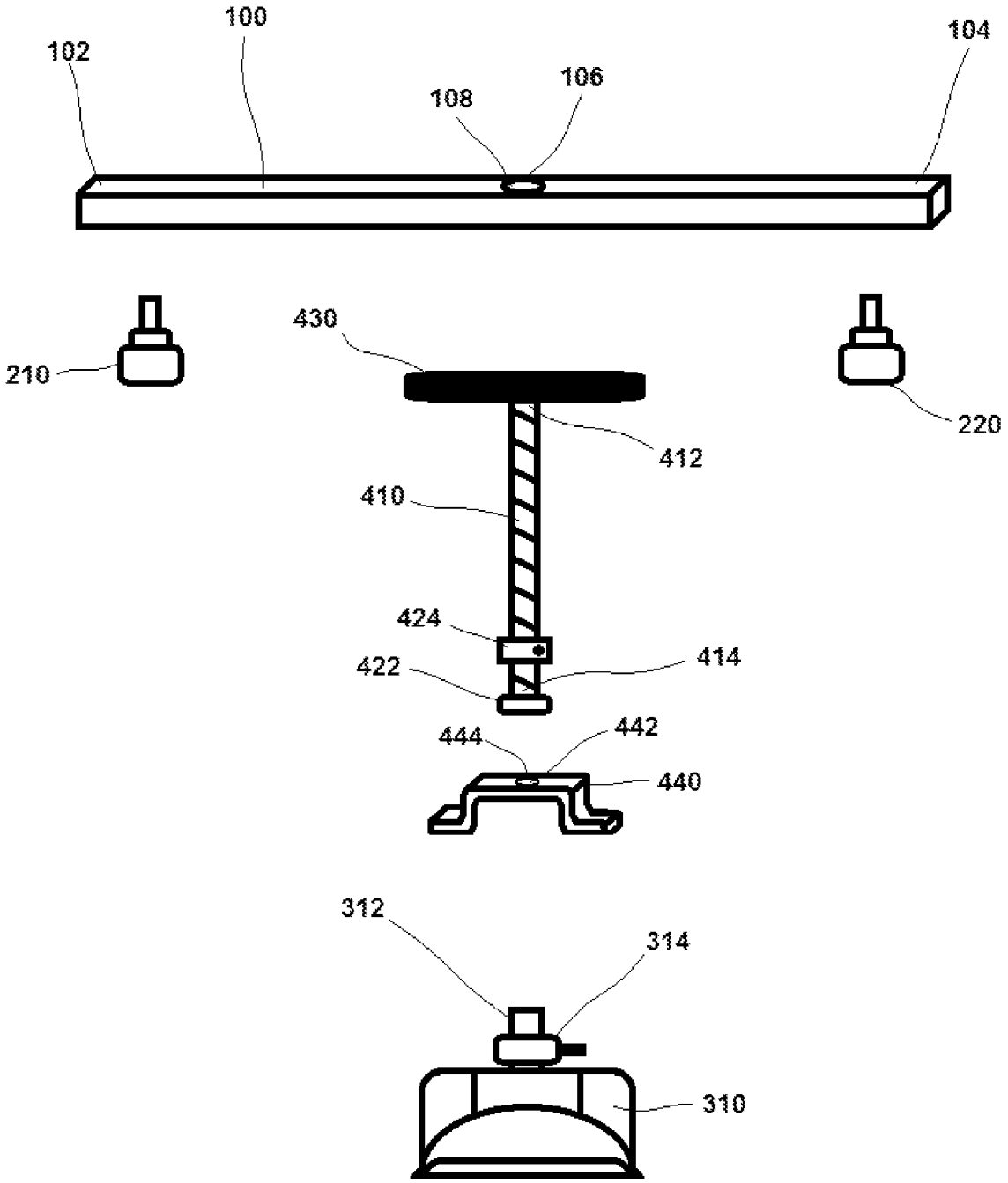
FIG. 3 is an exploded view of the components of the window bracing device depicted in FIG. 1.
Figure 4:
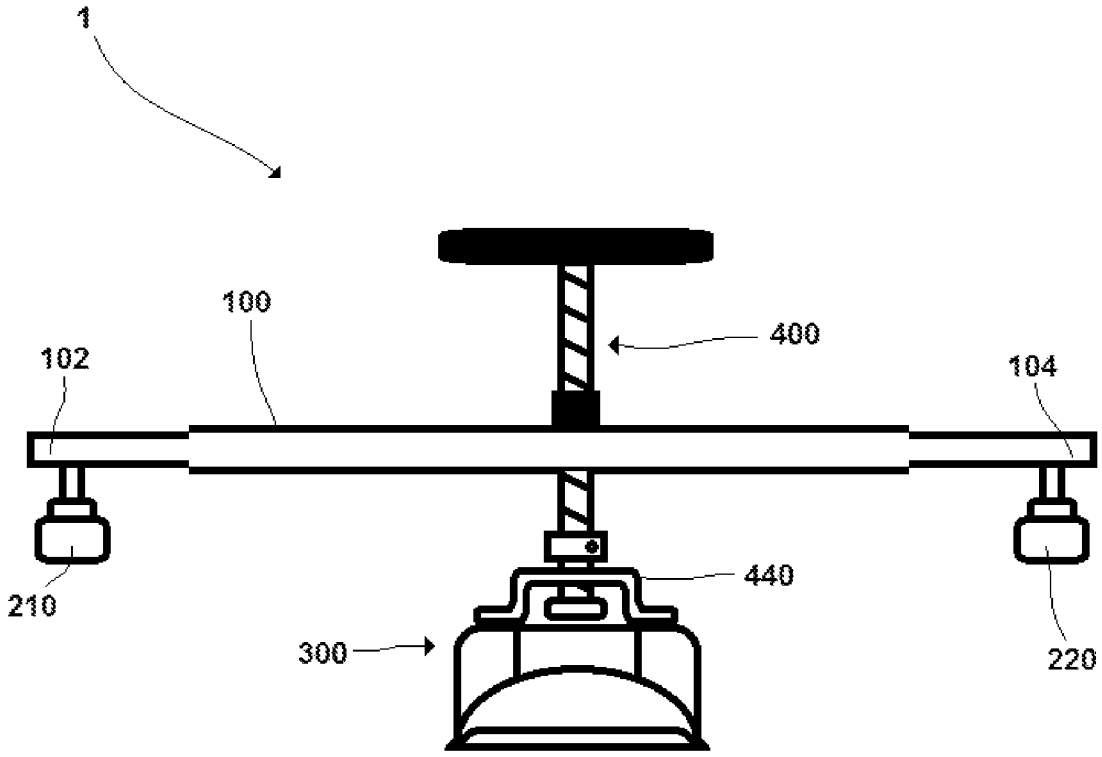
FIG. 4 is a plan front view of another embodiment of the window bracing device of the present invention, whereby the bracing arm has extendable ends.

The window bracing device 1 of the present invention is configured to be used with a window unit 10 having a glass window pane 12. The window unit 10 is to be fitted into a window opening 22 formed into the wall 20 of a structure. The window bracing device 1 holds the window unit 10 in place in the opening until it can be secured thereto. The window bracing device 1 comprises a bracing arm 100, a first foot 210, a second foot 220, a window engagement member 300, and an attachment component 400. The first foot 210 is located at one end 102 of the bracing arm 100, the second foot 220 is located at the other end 104 of the bracing arm 100, the attachment component 400 is located proximate to the midpoint 106 of the bracing arm 100, and the window engagement member 300 is located at the end of the attachment component 400.

The bracing arm 100 is an elongate, rigid member. It has a first end 102, a second end 104, a length, and a midpoint 106 located approximately midway between the first end 102 and the second end 104. The bracing arm 100 is constructed out of any rigid, durable material, such as steel, plastic, wood, composites, and the like. In the preferred embodiment it is constructed out of aluminum. The bracing arm 100 can also be shaped with a round cross section, a hexagonal cross section, a trapezoidal cross section, a rectangular cross section, or an irregular cross section. In the preferred embodiment the bracing arm 100 has a square cross section. The bracing arm 100 may be of solid construction, or it may be hollow.

In one variant, the bracing arm 100 is extendable at its first end 102, such that its overall length can be made longer or shorter by extending or retracting the first end 102 of the bracing arm 100. In another variant, the bracing arm 100 is also extendable at its second end 104. The overall length of the bracing arm 100 in these variants can be established by extending and/or retracting one or both ends. This allows the midpoint 106 of the bracing arm 100 to be repositioned with regard to the sides of the window unit 10 that the window bracing device 1 is bracing, as needed. In these variants, the ends of the bracing arm 100 may be extended using telescoping segments, as is well known in the art. Alternative structures may also be used, such as threaded end components that may be lengthened or shortened depending on the amount of rotation of the threaded components into each other. These variants may also comprise locking means, so that once the appropriate length is achieved the ends of the bracing arm 100 are locked into position, preventing further extension or retraction. Any locking means known in the art may be used. In the preferred embodiment a set screw inserted into an aperture of the bracing arm 100 is used to secure the extendable end of the bracing arm 100.

The first foot 210 is configured to engage with the wall 20 of the structure. It extends from the bottom of the bracing arm 100. Similarly, the second foot 220 is configured to engage with the wall 20 of the structure and extends from the bottom of the bracing arm 100 from the same side as the first foot 210. The first foot 210 is located proximate to the first end 102 of the bracing arm 100 and the second foot 220 is located proximate to the second end 104 of the bracing arm 100. In one variant, the first foot 210 is adjustable, such that the first foot 210 may be extended and retracted relative to the bracing arm 100. Similarly, the second foot 220 may be adjustable in the same way. Adjusting the first foot 210 and the second foot 220 allows the window bracing device 1 to be better fit against the wall 20 surrounding the window opening 22 regardless of the particular configuration of that wall 20. In the preferred embodiment, the first foot 210 is adjustable by having a threaded engagement with the first end 102 of the bracing arm 100, and the second foot 220 is adjustable by having a threaded engagement with the second end 104 of the bracing arm 100. Rotating each respective foot causes it to extend from or retract into the bracing arm 100. In other embodiments the first foot 210 and the second foot 220 each have an attachment shaft which slide within apertures formed into the first and second ends 102,104 of the bracing arm 100, respectively, and held to a desired amount of insertion by any means commonly known in the art, such as cotter pins, nuts, set screws, and the like.

The window engagement member 300 of the window bracing device 1 is configured to engage with the glass window pane 12 of the window unit 10. The window engagement member 300 is removably secured to the glass window pane 12, so that during use the window bracing device 1 does not move relative to the window unit 10, yet when desired the window bracing device 1 can be removed from the window unit 10. In the preferred embodiment the window engagement member 300 is a suction cup 310. Any configuration of suction cup 310 known in the art is permitted, as long at that configuration is suitable for attaching to a pane of glass and is also capable of detaching from the pane of glass when desired.

In one embodiment, the suction cup 310 of window engagement member 300 comprises a distending mechanism 312. The distending mechanism 312 is movable from a first position to a second position and incorporates means for locking the distending mechanism 312 in the second position and for unlocking the distending mechanism 312 so that it can be moved into the first position. The distending mechanism 312 changes the suction cup's 310 shape when it is moved into the second position, and allows the suction cup 310 to return to its original shape when it is moved into the first position. Thus, when the suction cup 310 is distended by the distending mechanism 312 being moved to the second position after the suction cup 310 is placed onto the glass window pane 12, the resulting distension of the suction cup 310 creates a seal attaching the suction cup 310 to the glass window pane 12. When it is desired to remove the window bracing device 1 from the window unit 10, the distending member is moved to the first position and the suction cup 310 returns to its original shape, thus breaking the seal between the suction cup 310 and the glass window pane 12. Distending mechanisms are well-known in the art. In a preferred embodiment, the distending mechanism 312 comprises a vertical extension attached to the apex of the exterior of the suction cup 310, with a rotatable ring 314 encircling the extension. A helical groove is formed into the extension, with which the encircling ring 314 engages. When the ring 314 is rotated, it moves within the groove, thereby moving the extension relative to the ring 314. As the extension is moved in a direction away from the surface to which the suction cup 310 is being attached, the suction cup 310 is distended and a seal is created. When the ring 314 is rotated in the opposite direction the extension moves in the opposite direction and the suction cup 310 returns to its original shape, breaking the seal. Other configurations are also contemplated.

The attachment component 400 is configured to attach the window engagement member 300 to the bracing arm 100. The attachment component 400 is attached to the bracing arm 100 at the midpoint 106 of the bracing arm 100, with the attachment component 400 being attached to the window engagement member 300 such that the window engagement member 300 is located on the same side of the bracing arm 100 as the first foot 210 and the second foot 220. In the preferred embodiment, the attachment component 400 is adjustably attached to the bracing arm 100, such that the attachment component 400 may be extended and retracted relative to the bracing arm 100. This allows the window bracing device 1 to accommodate windows 10 with window openings 22 of varying depths.

In the preferred embodiment, the attachment component 400 comprises a threaded shaft 410 having a first end 412, a second end 414, an upper portion 416 located proximate to the first end 412, and a lower portion 418 located proximate to the second end 414. The threaded shaft 410 is placed into and through a threaded aperture 108 formed through the bracing arm 100 and located proximate to the midpoint 106 of the bracing arm 100. The upper portion 416 of the threaded shaft 410 extends above the bracing arm 100 and the lower portion 418 of the threaded shaft 410 extends below the bracing arm 100. The window engagement member 300 is attached to the second end 414 of the threaded shaft 410. Rotation of the threaded shaft 410 in one direction causes it to move relative to the bracing arm 100 such that the upper portion 416 of the threaded shaft 410 moves into and through the bracing arm 100 and the lower portion 418 of the threaded shaft 410 moves out of and away from the bracing arm 100, resulting in the window engagement member 300 moving away from the bracing arm 100. Rotation of the threaded shaft 410 in the opposite direction causes it to move relative to the bracing arm 100 such that the lower portion 418 of the threaded shaft 410 moves into and through the bracing arm 100 and the upper portion 416 of the threaded shaft 410 moves out of and away from the bracing arm 100, resulting in the window engagement member 300 moving towards the bracing arm 100. In this embodiment, an optional knob 430 may be attached to the first end 412 of the threaded shaft 410, to facilitate rotation of the threaded shaft 410.

In another variant of the foregoing embodiment, the attachment component 400 comprises a yoke 440. The yoke 440 is rotationally attached to the second end 414 of the threaded shaft 410, and the window engagement member 300 is fixedly attached to the yoke 440. As such, the window engagement member 300 is capable of rotating relative to the attachment component 400. In this variant, the threaded shaft 410 may also comprise an end stop 422 and a yoke stop 424. The end stop 422 is located at the second end 414 of the threaded shaft 410 and the yoke stop 424 is located on the threaded shaft 410 proximate to the second end 414 of the threaded shaft 410 and spaced apart from the end stop 422. The yoke 440 has an aperture 442 located at its midpoint 444, with the aperture 442 sufficiently large to permit the threaded shaft 410 to be placed through it. The yoke aperture 442 is also smaller than the outside diameter of the end stop 422 and smaller than the outside diameter of the yoke stop 424. In this configuration, the threaded shaft 410 is placed through the yoke aperture 442 such that the yoke 440 is located proximate to the end stop 422, then the yoke stop 424 is placed onto the threaded shaft 410 proximate to the yoke aperture 442, with the yoke 440 free to rotate about the threaded shaft 410 between the end stop 422 and the yoke stop 424. Other variants of this embodiment are also contemplated.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching without departing from the subject or spirit of the invention as defined in the following claims. The exemplary embodiments, along with some variations, were chosen and described in order to best explain the principles of the present invention and its practical application. Those skilled in the art will recognize that many variations are possible within the spirit and scope of the invention in which all terms are meant in their broadest, reasonable sense unless otherwise indicated. Other embodiments not specifically set forth herein are therefore also within the scope of the following claims.

I claim:

1. A window bracing device, said window bracing device configured to be used with a window having a glass pane, said window having been fitted into a window opening formed into a wall of a structure, wherein said window bracing device comprises a bracing arm, said bracing arm being an elongate, rigid member having a first end, a second end, a length, and a midpoint located approximately midway between the first end and the second end;

a first foot located proximate to the first end of the bracing arm, said first foot configured to engage with the wall of the structure;

a second foot located proximate to the second end of the bracing arm, said second foot configured to engage with the wall of the structure, with the second foot being located on a same side of the bracing arm as the first foot;

a window engagement member, said window engagement member configured to directly engage with the glass pane of the window, such that the window engagement member is placed in direct contact with the glass pane of the window and removably secured thereto; and an attachment component, said attachment component configured to attach the window engagement member to the bracing arm, with the attachment component attached to the bracing arm proximate to the midpoint of the bracing arm and the attachment component attached to the window engagement member such that the window engagement member is located on the same side of the bracing arm as the first foot and the second foot;

whereby the window engagement member of the window bracing device is placed onto the glass pane of the window and secured thereto, the first foot of the window bracing device is aligned with a portion of the wall of the structure, and the second foot of the window bracing device is aligned with a different portion of the wall of the structure.

2. The window bracing device of claim 1, wherein the first foot is adjustably attached to the bracing arm, such that the first foot is configured to be extendable relative to the bracing arm and the first foot is configured to be retractable relative to the bracing arm.

3. The window bracing device of claim 1, wherein the second foot is adjustably attached to the bracing arm, such that the second foot is configured to be extendable relative to the bracing arm and the second foot is configured to be retractable relative to the bracing arm.

4. The window bracing device of claim 1, wherein the window engagement member is a suction cup.

5. The window bracing device of claim 4, wherein the suction cup of window engagement member comprises a distending mechanism, wherein the distending mechanism is configured to be movable from a first position to a second position and incorporates means for locking the distending mechanism in the second position and for unlocking the distending mechanism so that the distending mechanism is movable into the first position, whereby the suction cup retains the suction cup's basic shape when the distending mechanism is in the first position, and the suction cup is distended when the distending mechanism is moved to the second position, such that when the suction cup is placed onto the glass pane and the distending mechanism is moved to the second position the resulting distension of the suction cup creates a seal attaching the suction cup to the glass pane, and when the distending member is moved to the first position the suction cup returns to the suction cup's basic shape and the seal between the suction cup and the glass pane is broken, thereby allowing the suction cup to be removed from the glass pane.

6. The window bracing device of claim 1, wherein the bracing arm is extendable at the first end of said bracing arm, such that the length of the bracing arm is configured to be made longer by extending the first end of the bracing arm and the length of the bracing arm is configured to be made shorter by retracting the first end of the bracing arm.

7. The window bracing device of claim 6, wherein the bracing arm is extendable at the second end of said bracing arm, such that the length of the bracing arm is configured to be made longer by extending the second end of the bracing arm and the length of the bracing arm is configured to be made shorter by retracting the second end of the bracing arm.

8. The window bracing device of claim 6, wherein the extendable first end of the bracing arm is configured to have a locked mode and an unlocked mode, wherein the locked mode prevents extension or retraction of the first end of the bracing arm, and the unlocked mode allows extension and retraction of the first end of the bracing arm.

9. The window bracing device of claim 7, wherein the extendable second end of the bracing arm is configured to have a locked mode and an unlocked mode, wherein the locked mode prevents extension or retraction of the second end of the bracing arm, and the unlocked mode allows extension and retraction of the second end of the bracing arm.

10. The window bracing device of claim 7, wherein the bracing arm is constructed of aluminum.

11. The window bracing device of claim 1, wherein the attachment component is adjustably attached to the bracing arm, such that the attachment component is configured to be extendable relative to the bracing arm and the attachment component is configured to be retractable relative to the bracing arm.

12. The window bracing device of claim 11, wherein the attachment component is adjustably attached to the bracing arm by means of a threaded shaft having a first end, a second end, an upper portion located proximate to the first end, and a lower portion located proximate to the second end, said threaded shaft being placed into and through a threaded aperture formed through the bracing arm and located proximate to the midpoint of the bracing arm, such that the upper portion of the threaded shaft extends above the bracing arm and the lower portion of the threaded shaft extends below the bracing arm, with the window engagement member attached to the second end of the threaded shaft, whereby rotation of the threaded shaft in one direction causes the threaded shaft to move relative to the bracing arm such that the upper portion of the threaded shaft moves into and through the bracing arm and the lower portion of the threaded shaft moves out of and away from the bracing arm, and rotation of the threaded shaft in an opposite direction causes the threaded shaft to move relative to the bracing arm such that the upper portion of the threaded shaft moves out of and away from the bracing arm and the lower portion of the threaded shaft moves into and through the bracing arm.

13. The window bracing device of claim 12, wherein the attachment component comprises a knob attached to the first end of the threaded shaft.

14. The window bracing device of claim 12, wherein the attachment component comprises a yoke, said yoke being rotationally attached to the second end of the threaded shaft, with the window engagement member fixedly attached to the yoke, such that the window engagement member is capable of rotating relative to the attachment component.

15. The window bracing device of claim 14, wherein the threaded shaft of the attachment component comprises an end stop and a yoke stop, said end stop being located at the second end of the threaded shaft and said yoke stop being located on the threaded shaft proximate to the second end of the threaded shaft and spaced apart from the end stop, with the yoke having an aperture located at a midpoint, with the aperture of the yoke sufficiently large to permit the threaded shaft to be placed through the aperture of the yoke, and with the aperture of the yoke being smaller than an outside diameter of the end stop and smaller than an outside diameter of the yoke stop, whereby the threaded shaft is placed through the aperture of the yoke such that the yoke is proximate to the end stop and the yoke stop is placed onto the threaded shaft proximate to the yoke aperture, with the yoke free to rotate about the threaded shaft between the end stop and the yoke stop.

* * * * *